US007377827B1

(12) United States Patent
Sturdy et al.

(10) Patent No.: US 7,377,827 B1
(45) Date of Patent: May 27, 2008

(54) MARINE PROPULSION SHIFT CONTROL

(75) Inventors: David Ronald Sturdy, Wilmington, NC (US); James Derek Gallaher, Leland, NC (US); Oscar Lee Meek, Wilmington, NC (US)

(73) Assignee: Sturdy Corporation, Wilmington, NC (US)

( * ) Notice: Subject to any disclaimer, the term of this patent is extended or adjusted under 35 U.S.C. 154(b) by 292 days.

(21) Appl. No.: 10/841,998

(22) Filed: May 7, 2004

Related U.S. Application Data

(60) Provisional application No. 60/480,429, filed on Jun. 20, 2003.

(51) Int. Cl.
*B63H 21/21* (2006.01)
*B63B 23/08* (2006.01)
*B63B 23/30* (2006.01)

(52) U.S. Cl. ..... 440/84; 440/86; 477/115

(58) Field of Classification Search ..... 440/75, 440/86–88, 1, 84; 477/115–117, 156, 159; 192/21, 51, 103 R
See application file for complete search history.

(56) References Cited

U.S. PATENT DOCUMENTS 3,780,755 A 12/1973 Matsuda et al.
4,667,540 A 5/1987 Yagi
4,688,665 A 8/1987 Rowen
4,726,798 A 2/1988 Davis
4,742,732 A 5/1988 Hiramatsu
4,799,158 A 1/1989 Patil
4,836,055 A 6/1989 Suzuki
4,855,914 A 8/1989 Davis et al.
4,942,783 A 7/1990 Morimoto
5,085,302 A * 2/1992 Kriesels ..... 192/51
5,125,293 A 6/1992 Takizawa
5,474,480 A * 12/1995 Schwarz et al. ..... 440/86
5,711,742 A 1/1998 Leinonen et al.
5,813,943 A 9/1998 Kousaka et al.
5,910,175 A 6/1999 Malson
6,102,755 A 8/2000 Hoshiba
6,168,547 B1 1/2001 Kawamura
6,293,838 B1 9/2001 Ferguson
6,421,597 B2 7/2002 Kon et al.
6,470,852 B1 10/2002 Kanno
6,478,715 B1 11/2002 Hunold (Continued)

FOREIGN PATENT DOCUMENTS

JP 63222999 A * 9/1988

(Continued)

*Primary Examiner*—Ajay Vasudeva
(74) *Attorney, Agent, or Firm*—Reising, Ethington, Barnes, Kisselle, P.C.

(57) ABSTRACT

A marine propulsion system that utilizes a transmission shift sequence to control shifting of the propulsion system transmission between forward and reverse gears. The marine propulsion system includes a controller that executes the transmission shift sequence using engine speed and transmission fluid pressure signals to determine the timing of various steps in the shift sequence. The controller is connected to a shift actuator for the transmission and to an engine speed throttle to thereby control transmission shifting and engine speed as a part of the transmission shift sequence. By monitoring engine speed and transmission fluid pressure, and by controlling transmission shifting and engine speed settings, the transmission shift sequence can provide the operator with the ability to carry out quick shifts that will neither stall the engine nor damage the transmission clutch.

20 Claims, 3 Drawing Sheets

U.S. PATENT DOCUMENTS 6,517,396 B1 2/2003 Into
6,679,740 B1 * 1/2004 Imanaka et al. ..... 440/75

FOREIGN PATENT DOCUMENTS

JP 01098744 A * 4/1989
JP 06213254 A * 8/1994
JP 10278890 A 10/1998
JP 2001071995 A * 3/2001

* cited by examiner

MARINE PROPULSION SHIFT CONTROL

CROSS REFERENCE TO RELATED APPLICATION

This application claims the benefit of the priority of U.S. Provisional Application Ser. No. 60/480,429, filed Jun. 20, 2003, the entire contents of which are hereby incorporated by reference.

TECHNICAL FIELD

The present invention relates to a method and apparatus for controlling transmission shifts in a marine propulsion system.

BACKGROUND OF THE INVENTION

Marine vessels in use today use marine propulsion systems that typically include the following sub-systems: an engine to provide power, a transmission to transfer drive power to a propeller, and a control system to provide control of engine speed and transmission engagement. An operator or pilot of the vessel nominally has control of the engine speed and transmission shifting through one or more operator controls. Using these operator controls, the transmission can be shifted between forward and reverse, usually through a neutral (transmission disengaged) position, and the engine speed can be set as desired by the operator.

Engine stalling is a problem sometimes encountered when operating a marine vessel, and often this occurs when the vessel is moving in one direction at high speed and the operator suddenly shifts the transmission into the opposite gear. The stall is the result of the linear momentum of the vessel moving through the water which imparts a drag load on the propeller that tends to keep the propeller, transmission, and engine rotating in the same direction. Reversing the transmission under these circumstances, however, places a sudden increased load on the engine because of the drag load on the propeller. As a result, the engine is often unable to overcome the sudden increased load and, therefore, the engine stalls.

Another problem can arise when a pilot attempts to avoid the engine stalling problem. Faced with a potential engine stall, a pilot will often "race" the engine prior to shifting it into the reverse gear. Racing the engine, however, can lead to transmission clutch damage caused by excessive engine speed prior to full engagement of the transmission clutch to the engine. To avoid damage to the transmission, marine transmission manufacturers recommend maximum acceptable engine speeds (typically 1,000 RPM) for all transmission shifts including neutral to forward or reverse, and forward or reverse through neutral to the opposite gear. Exceeding the maximum acceptable engine speed during a shift tends to result in excessive clutch temperatures and possibly clutch failure.

Attempts to alleviate the above problems usually involve using electronic controls, or "blind timers", to delay the time between shifting the transmission and increasing of the speed of the engine to allow the transmission clutch to fully engage the engine and propeller driveshaft. This method is only effective under specific conditions, such as where the drag load on the propeller decreases by a sufficient amount during the time delay such that the engine can overcome the sudden increased load without stalling. In some instances, however, this method may be ineffective because the shift is not delayed long enough and the engine stalls, or because the delay is too long resulting in an unnecessarily long shift delay.

SUMMARY OF THE INVENTION

In accordance with one aspect of the present invention, there is provided a method of controlling a marine vessel transmission to shift the transmission from an initial gear position to an opposite gear position. A request to shift the transmission from the initial gear position into the opposite gear position is received, engine speed and transmission fluid pressure is measured, and a transmission shift sequence is carried out using the measured engine speed and transmission fluid pressure.

In accordance with another aspect of the invention, there is provided a control system for controlling a marine engine and marine transmission. The control system includes a control module having a controller, a transmission fluid pressure sensor coupled to the controller to provide a transmission fluid pressure signal, and an engine speed sensor coupled to the controller to provide an engine speed signal. The controller is operable to control shifting of the transmission between forward and reverse gears using the engine speed signal and transmission fluid pressure signal.

In accordance with a further aspect of the invention, there is provided a marine propulsion system including an engine, a transmission coupled to the engine by a clutch to permit selective engagement and disengagement with the engine, and a propulsion unit coupled to the transmission. A controller is provided in communication with the engine and the transmission. An operator input device includes a position sensor that is coupled to the controller to permit an operator to input a transmission shift request. The transmission further includes a transmission shift actuator coupled to the controller to receive shift commands from the controller, and also includes a transmission fluid pressure sensor coupled to the controller. The engine includes an engine speed actuator coupled to the controller to receive speed commands from the controller, and further includes an engine speed sensor coupled to the controller. In response to receiving a transmission shift request from the operator input device, the controller determines one or more shift commands using signals from the sensors and sends the shift command(s) to the transmission shift actuator to thereby provide a controlled shifting of the transmission in a manner that reduces wear to the clutch and avoids engine stalls.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

Figure 1:
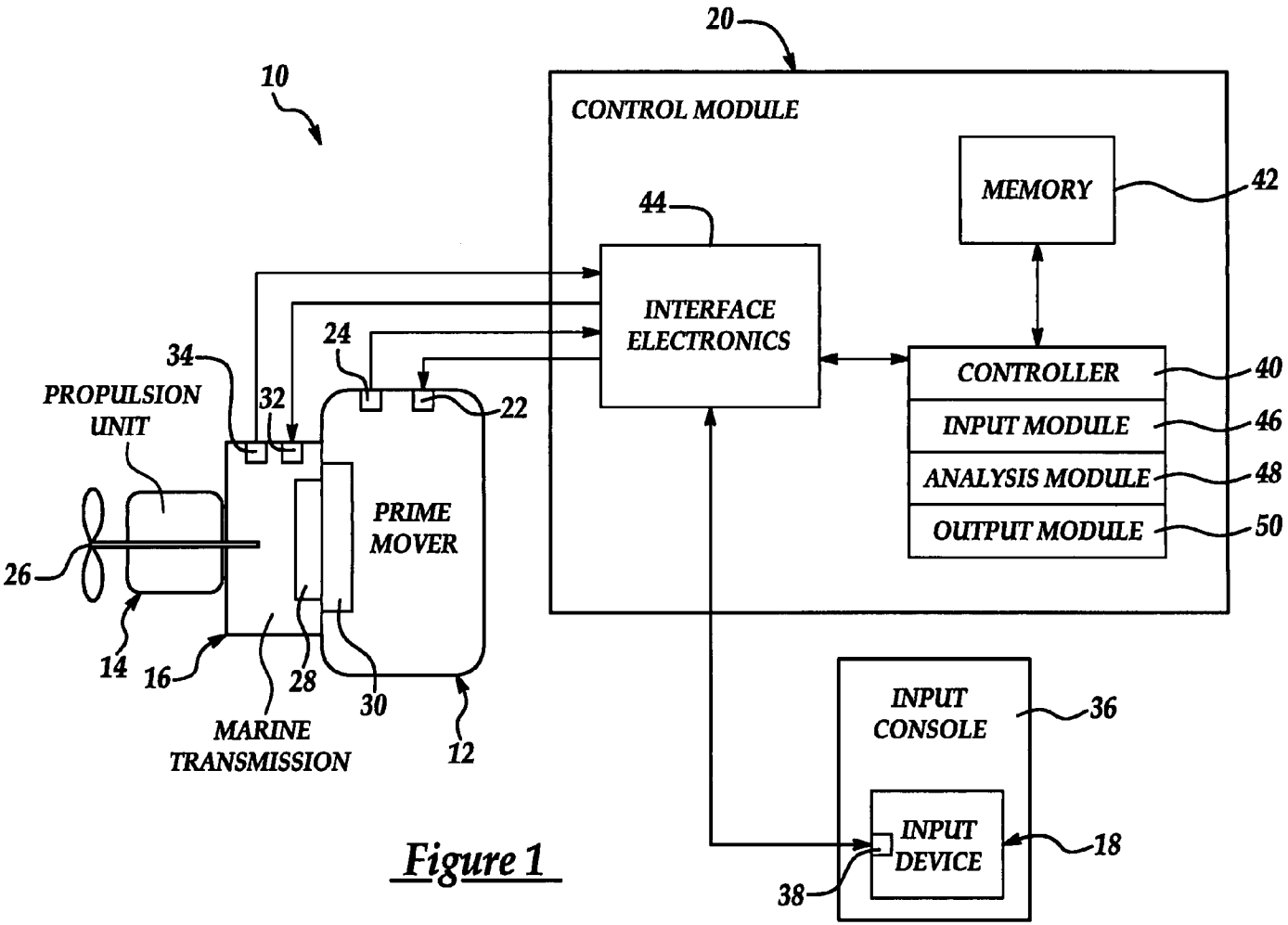
FIG. 1 is a block diagram of a marine propulsion system.

FIG. 1 illustrates a block diagram of a marine propulsion system 10 according to an embodiment of the present invention. The marine propulsion system 10 generally resides within a marine vessel (not shown) and includes the following main elements: a prime mover (engine) 12 for powering the vessel, a propulsion unit 14 for propelling the vessel, a marine transmission 16 for converting the output of the engine 12 into an input to the propulsion unit 14, a throttle control lever 18 or other manual input device used by the pilot to control transmission shifting and engine speed, and a control module 20 for controlling the engine 12 and transmission 16 in response to the manual input from the pilot.

The engine 12 is mounted to the vessel as is well-known in the art and, as used herein, the term "engine" means an internal combustion engine, a turbine engine, electric motor, and the like. For example, an internal combustion engine provides rotational power from a crankshaft (not shown) that rotates at the speed or revolution rate (RPM) of the engine 12. The engine 12 can include an electronically controlled actuator or throttle 22 such as by a throttle servo, and also includes a speed sensor 24 for measuring the rotational speed of the crankshaft or output shaft. The speed sensor 24 generates an output engine speed signal that is provided to the control module 20.

The propulsion unit 14 is mounted to the vessel as is well-known in the art and may encompass a simple drive shaft and propeller 26, or a more elaborate device such as an sterndrive unit made by OMC, Mercury Marine, and the like.

The marine transmission 16 is also mounted to the vessel and is connected between the propulsion unit 14 and engine 12. As is well-known in the art, the marine transmission 16 is coupled to both the propulsion unit 14 and the engine 12, but can be selectively engaged and disengaged from the engine 12 using any of a variety of clutch or other coupling mechanisms. For example, the marine transmission can utilize a transmission clutch 28 that engages a flywheel 30 mounted to the output shaft of the engine 12. Separate forward and reverse clutches can be used. Alternatively, it can use a fluid coupling, such as a torque converter. As used herein, the term "clutch" includes all of these as well as other suitable coupling mechanisms.

The marine transmission 16 is a variable speed device that includes forward, neutral, and reverse gear settings. The clutch 28 used in the transmission is activated using transmission oil as is well known, and can include a solenoid-operated actuator or valve 32 or other device to provide electronic control of the transmission oil pressure for purposes of shifting. The solenoid receives a control signal from the control module 20 and adjusts the valve 32 accordingly to control the transmission fluid to either engage or disengage the transmission clutch 28, and/or to engage or disengage low or high gearsets (not shown). The transmission 16 includes a transmission fluid pressure sensor 34 for measuring the fluid pressure within the transmission 16. This sensor 34 generates a transmission fluid pressure signal that is provided to the control module 20.

The throttle control lever 18 or other manual input device is typically mounted within a cockpit (not shown) of the marine vessel and is provided to convert a speed and/or directional request from a marine vessel operator to an electronic signal. The input device can be, for example, a combined transmission and engine throttle control lever 18 mounted on a control console 36. The control lever mechanism 18 can include a transducer or position sensor 38 for generating and outputting to the control module 20 a suitable direction signal that is representative of the angular position of the operator control lever 18.

The control module 20 monitors various marine propulsion system parameters by receiving inputs of engine speed, transmission fluid pressure, and operator requests for speed and direction via the throttle control lever 18. In the illustrated embodiment, the control module 20 includes a controller 40, a memory 42, and interface electronics 44. A variety of other control module circuit designs and configurations can be used in lieu of that shown. The interface electronics 44 may conform to protocols such as RS-232, parallel, small computer system interface, and universal serial bus, etc. Moreover, the interface electronics 44 can include circuits or software for developing the drive signals needed to actuate the engine throttle 24 and transmission shift solenoid 32, etc. The memory 42 can be RAM, ROM, EPROM, and the like, and can be a separate component or integrated into the controller 40 itself. The controller 40 is configured to provide control logic that provides the functionality for the marine propulsion system. In this respect, the controller 40 may comprise a microprocessor, a microcontroller, an application specific integrated circuit, and the like. The controller 40 is interfaced with the memory 42 which provides storage of the computer software that provides the functionality of the marine propulsion system 10 and that may be executed by the controller 40. The memory 42 may also be configured to provide a temporary storage area for data received by the marine propulsion system 10 from the sensors 24, 34, 38 or even from a separate host device, such as a computer, server, workstation, and the like (not shown).

The controller 40 includes an input module 46 which can simply be data inputs for receiving the commanded throttle and/or transmission shift signal from the operator, as well as the engine speed signal from the engine 12 and the transmission pressure signal from the marine transmission 16. The controller 40 also includes an analysis module 48 which can be a software module or routine that is a part of the main control program that is executed by the controller 40 and that determines the appropriate transmission shifting and engine speed control signals that are to be sent to the transmission 16 and engine 12, respectively. For example, based on the direction signal, the controller 40 outputs a control signal to the engine throttle servo 22 so as to position the engine throttle 22 in a position that is proportional to the operator control lever 18 position. The controller 40 further includes an output module 50 which can be various data outputs connected to the interface electronics 44 that supply the control signals to the engine 12 and transmission 16.

Figure 2:
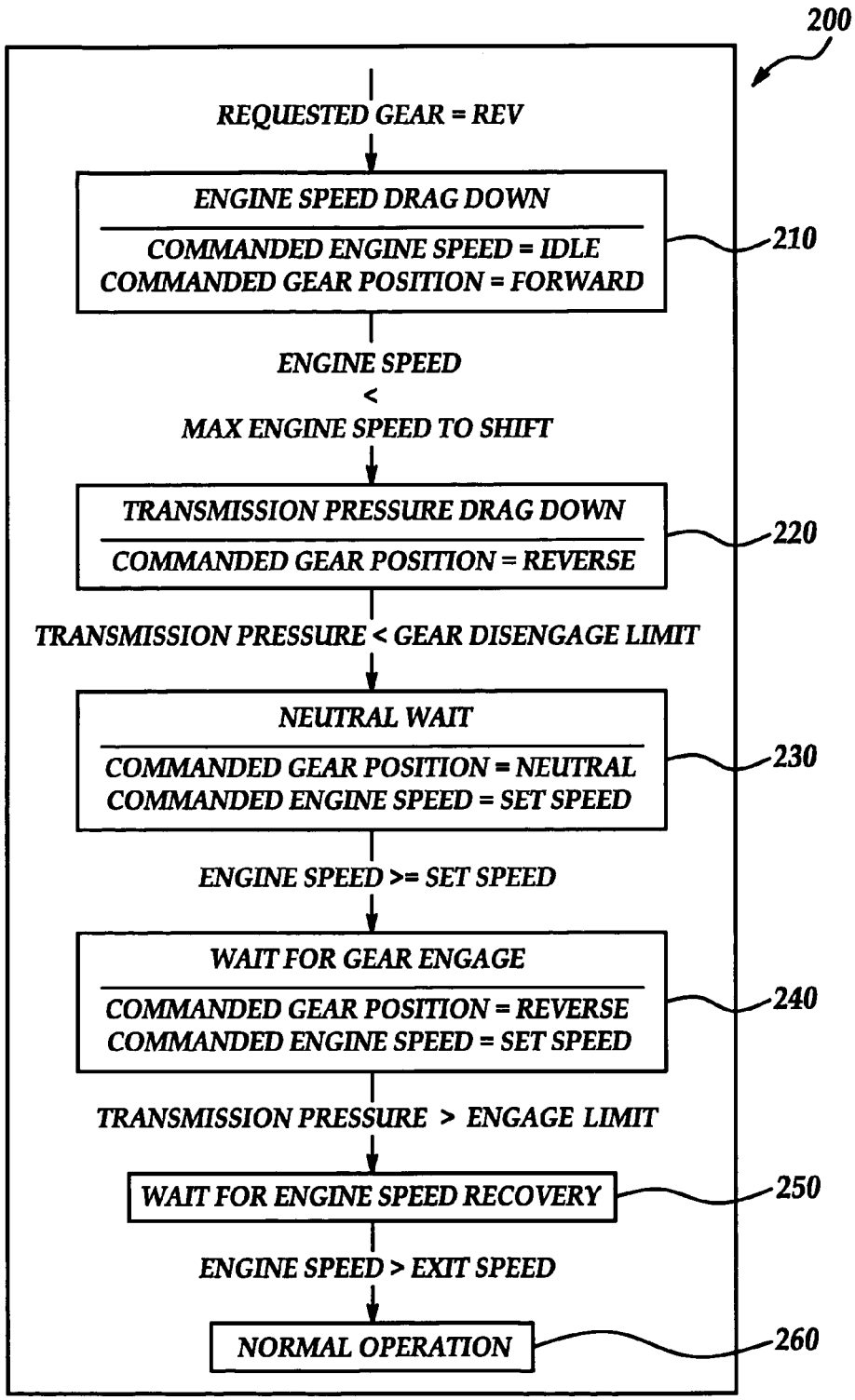
FIG. 2 is a flow and state diagram showing an algorithm for a marine transmission shift from forward to reverse, or vice-versa.
Figure 3:
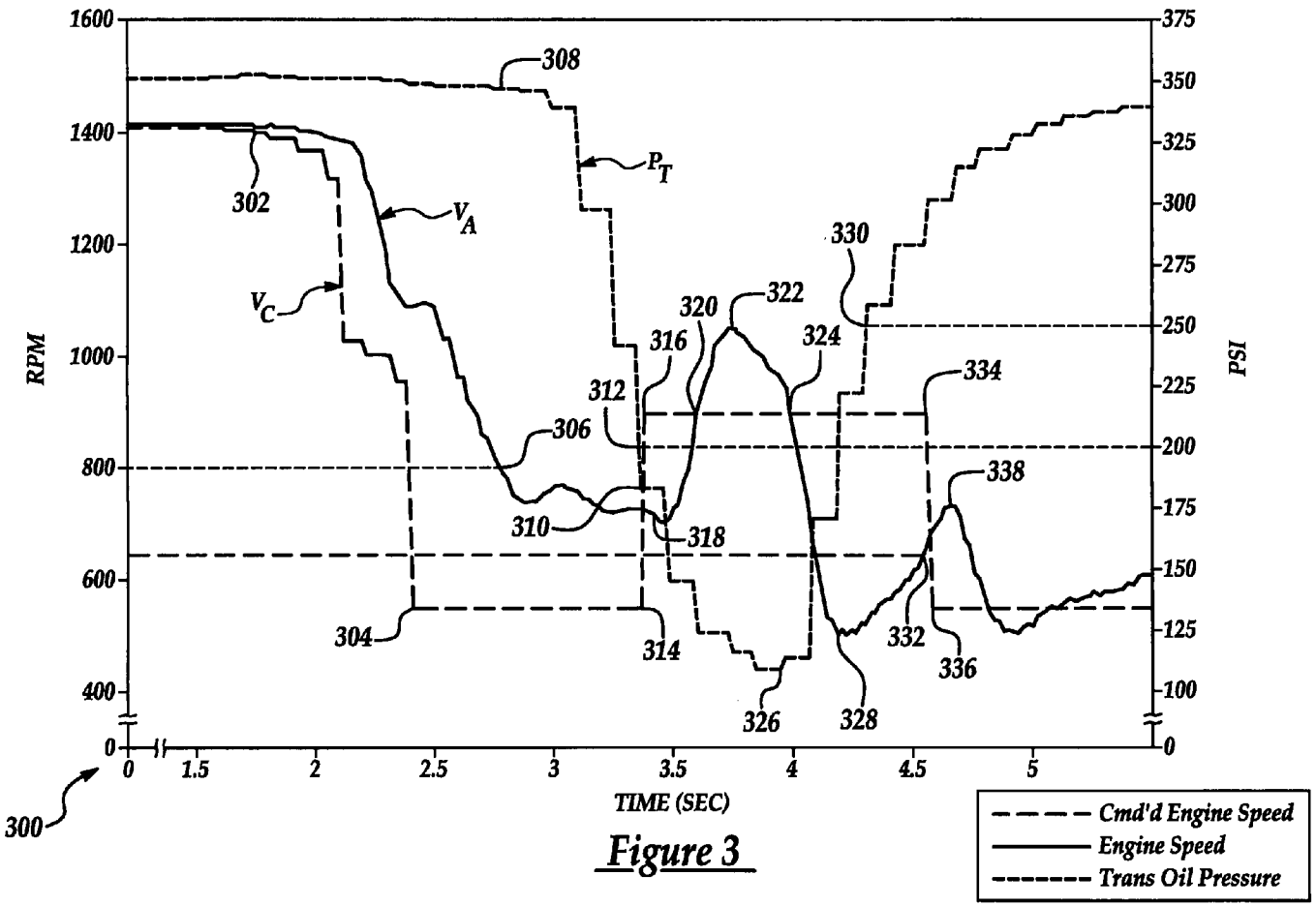
FIG. 3 is a graphical representation of a transmission shift including time vs. commanded engine speed, actual engine speed, and transmission fluid pressure.

Referring now primarily to FIG. 2 in addition to FIGS. 1 and 3, a method 200 of controlling the marine propulsion system 10 is provided according to an embodiment of the present invention. During regular operation of the marine vessel, the controller 40 receives requested gear shifts and/or throttle changes from the operator and generates the appropriate control signals for the transmission 16 and/or engine throttle 22. When the controller 40 receives a request from the operator to shift the transmission 16 into an opposite gear (e.g., forward to reverse or vice-a-versa), the controller 40 carries out the transmission shift sequence of FIG. 2. Detection of this shift request and the carrying out of the transmission shift sequence can be done using the analysis module routine of the controller software. For the illustrated embodiment, FIG. 3 depicts an exemplary graph 300 of commanded engine speed $v_C$, actual engine speed $v_A$, and transmission fluid pressure $P_T$ values versus time that results from the transmission shift sequence of FIG. 2.

The transmission shift sequence is carried out by the software control program in the controller 40. This process can be carried out upon a transmission shift to an opposite gear, or can also be done each time a shift from neutral into forward or reverse gear is requested. The process involves the following steps.

ENGINE SPEED DRAG DOWN 210. First, the controller 40 commands the engine throttle 22 to idle (e.g., 550 RPM) from its current speed setting and maintains the current (or initial) transmission gear position. This command is represented graphically in FIG. 3 by plot $v_C$, between points 302 and 304. This command reduces the engine speed $v_A$ as quickly as possible without stalling the engine 12 and to a point where a shift may occur without damage to the clutch 28 or other transmission parts. Before proceeding to the next step, the controller 40 waits until the engine speed $v_A$ falls below point 306 which represents a predetermined "Maximum Engine Speed To Shift", such as 800 RPM.

TRANSMISSION PRESSURE DRAG DOWN 220. After the engine speed $v_A$ has dropped below the "Maximum Engine Speed To Shift" value, the controller 40 commands the transmission 16 to reverse the initial gear position, from forward to reverse, or vice-versa. In effect, this command enables the transmission fluid pressure $P_T$ to drop quickly and is represented between points 308 and 310 of plot $P_T$ of FIG. 3. Before proceeding to the next step, the controller 40 waits for disengagement of the transmission 16 out of the initial gear position by waiting until the transmission fluid pressure $P_T$ falls below a predetermined maximum gear "Disengage Limit", such as 200 PSI. The Disengage Limit is represented graphically in FIG. 3 by point 312. This delay ensures complete disengagement of the transmission clutch from the engine 12 to prevent clutch 28 burn up.

NEUTRAL WAIT 230. Once the transmission fluid pressure $P_T$ has fallen below the "Disengage Limit", the controller 40 overrides the previous command to reverse gear position and now commands the transmission 16 to the neutral gear position. The controller 40 also commands the engine speed to a "Set Speed" value, such as 900 RPM. This command is represented graphically in FIG. 3 by points 314 and 316 of plot $v_C$. As represented between points 318 and 320 of plot $v_A$ in FIG. 3, this command permits the engine speed Va to rise quickly to the "Set Speed" value, which is high enough to enable engagement of the transmission 16 into an opposite gear position, without loading and stalling the engine 12. Note that the transmission 16 has not yet completely reversed from the initial gear position all the way through neutral and actually into the opposite gear position. In other words, the Neutral Wait step 230 interrupts the reverse gear command to prevent damage to the transmission 16 and engine 12. Before proceeding to the next step, the controller 40 waits for the engine speed $v_A$ to reach "Set Speed" at point 320. Thereafter, the engine speed $v_A$ peaks at point 322 and drops back toward the commanded "Set Speed" value.

WAIT FOR GEAR ENGAGE 240. Next, the controller 40 maintains the commanded engine speed $v_C$ at "Set Speed" and commands the transmission 16 to the reverse gear position. Accordingly, the transmission 16 moves from neutral to the gear setting that is opposite of the initial gear setting, and the transmission clutch 28 engages the engine 12. This clutch engagement is represented graphically in FIG. 3 by the rapid rise in transmission fluid pressure $P_T$ beginning at point 326 and by the concurrent rapid drop in actual engine speed $v_A$ beginning at point 324, after which the engine speed $v_A$ bottoms out at point 328, but thereafter begins recovery due to the continued application of the "Set Speed" command. But, before proceeding to the next step, the controller 40 waits until the transmission fluid pressure $P_T$ increases above a predetermined "Engage Limit", such as 250 PSI, which is graphically represented at point 330 of FIG. 3. This indicates that the transmission clutch 28 has fully engaged the engine 12 and that the engine speed can be increased without damaging the transmission 16.

WAIT FOR ENGINE SPEED RECOVERY 250. Engagement of the clutch 28 in the opposite gear from the initial gear setting places a load on the engine 12 that will slow the engine speed $v_A$, perhaps even below idle. Accordingly, the commanded engine speed $v_C$ is held at "Set Speed" while the controller 40 waits until the actual engine speed $v_A$ climbs back toward "Set Speed" and actually reaches an "Exit Speed", such as 650 RPM, which is represented by point 332 of FIG. 3. The "Exit Speed" is the speed at which the engine 12 is deemed to have recovered from the load placed thereon by the transmission clutch engagement. As depicted by points 334 and 336 on plot $v_C$ of FIG. 3, once the engine 12 has recovered to the "Exit Speed" setpoint, the controller 40 resumes normal operation 260 commanding the engine speed to that set by the marine vessel operator and, in effect, relinquishing speed control back to the operator. For example, the commanded engine speed $v_C$ can default to the idle speed as depicted by point 336 of FIG. 3. Following the command, the engine speed $v_A$ peaks at point 338 and drops toward the commanded idle speed. From this point on, the marine vessel operator can increase or decrease engine speed at will, until another reverse gear request is made wherein the method 200 repeats.

Accordingly, the present invention helps alleviate many problems in the prior art including excessive shift time, engine stalls, and transmission damage. To protect the transmission 16, the controller 40 limits engine speed to less than the "Maximum Engine Speed To Shift" until the transmission pressure $P_T$ reaches the "Engage Limit". This indicates that the transmission clutch 28 has effectively coupled the propulsion unit 14 to the engine 12 and that the engine speed may now be increased without damaging the transmission 16. To achieve a minimum shift time, and still avoid engine stalling under a high speed high load transmission shift, the controller 40 compares several inputs (including requested direction, engine speed, and transmission fluid pressure) against several optimum predetermined setpoints. One of ordinary skill in the art will recognize that the various setpoints may vary from application to application and may be dictated by manufacturers of one or more of the engine, marine transmission, marine vessel, etc.

The method 200 described herein can be implemented via a computer program and the various setpoints may be stored in memory as individual data points or in a look-up table or the like. The computer program may exist in a variety of forms both active and inactive. For example, the computer program can exist as software program(s) comprised of program instructions in source code, object code, executable code or other formats; firmware program(s); or hardware description language (HDL) files. Any of the above can be embodied on a computer readable medium, which include storage devices and signals, in compressed or uncompressed form. Exemplary computer readable storage devices include conventional computer system RAM (random access memory), ROM (read only memory), EPROM (erasable, programmable ROM), EEPROM (electrically erasable, programmable ROM), and magnetic or optical disks or tapes.

It will thus be apparent that there has been provided in accordance with the present invention a control method and apparatus for a marine propulsion system that achieves the aims and advantages specified herein. It will of course be understood that the foregoing description is of preferred exemplary embodiments of the invention and that the invention is not limited to the specific embodiments shown. Various changes and modifications will become apparent to those skilled in the art and all such variations and modifications are intended to come within the scope of the appended claims.

As used in this specification and appended claims, the terms "for example" and "such as," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that necessarily requires a different interpretation.

The invention claimed is:

1. A method of controlling a marine vessel transmission to shift the transmission from an initial gear position to an opposite gear position, said method comprising the steps of:

receiving a request to shift the transmission from the initial gear position into the opposite gear position;

measuring engine speed and transmission fluid pressure; and carrying out a transmission shift sequence using the measured engine speed and transmission fluid pressure.

2. The method set forth in claim 1, wherein the transmission shift sequence further comprises the steps of decreasing engine speed and commanding at least one transmission shift to the opposite gear position.

3. The method set forth in claim 1, wherein the transmission shift sequence includes a plurality of steps that includes at least one step of decreasing engine speed and at least one step of sending a transmission shift command to effect a shift of the transmission out of the initial gear position.

4. The method set forth in claim 3, wherein the transmission shift sequence further comprises waiting until the engine speed passes a predetermined speed value before carrying out one or more of the steps of the sequence.

5. The method set forth in claim 3, wherein the transmission shift sequence further comprises waiting until the transmission fluid pressure passes a predetermined pressure value before carrying out one or more of the steps of the sequence.

6. The method set forth in claim 1, wherein the transmission shift sequence comprises:

commanding the engine speed to an idle speed;

detecting when the engine speed has fallen below a first speed value and thereafter sending a first transmission shift command to shift the transmission to the opposite gear position;

detecting when the transmission fluid pressure has fallen below a first pressure value and thereafter sending a second transmission shift command to shift the transmission to neutral and sending a speed command to increase the engine speed above the idle speed;

sending a third transmission shift command to shift the transmission to the opposite gear position after the engine speed has increased above a second speed value; and maintaining the speed command at a value above the idle speed until the transmission fluid pressure has increased above a second pressure value and the engine speed has increased above a third speed value.

7. A method of controlling a marine vessel transmission to shift the transmission between forward and reverse gear positions, comprising the steps of:

receiving a request to shift the transmission from an initial gear position to an opposite gear position; and executing a transmission shift sequence that comprises sending to said transmission at least three transmission shift commands including a first command to shift into the opposite gear position, a second command to shift into neutral, and a third command to again shift into the opposite gear position, wherein the transmission shift sequence further comprises the following steps before the first command:

commanding engine speed to a value below a predetermined maximum engine speed to shift value; and maintaining the initial gear position.

8. The method set forth in claim 7, wherein the first command comprises commanding the transmission to the opposite gear position after the engine speed falls below the predetermined maximum speed to shift value, thereby enabling the transmission fluid pressure to drop.

9. The method set forth in claim 8, wherein the second command comprises commanding the transmission to neutral after the transmission fluid pressure falls below a predetermined maximum gear disengage limit, and wherein the transmission shift sequence further includes the step of commanding the engine speed to a predetermined set speed value that enables engagement of the transmission into the opposite gear position without stalling the engine.

10. The method set forth in claim 9, wherein the transmission shift sequence further includes the step of maintaining the commanded engine speed at the predetermined set speed value, and wherein the third command comprises commanding the transmission to the opposite gear position after the engine speed has reached the predetermined set speed value.

11. The method set forth in claim 10, wherein the transmission shift sequence further comprises the steps of:

waiting until the transmission fluid pressure increases above a predetermined engage limit;

waiting until the engine speed increases to an exit speed; and relinquishing engine speed control to a marine vessel operator when the transmission fluid pressure reaches the predetermined engage limit and when the engine speed reaches the exit speed.

12. A method of controlling a marine propulsion system having a transmission, comprising the steps of:

receiving a request to shift the transmission from an initial gear position to an opposite gear position;

commanding the transmission to shift to the opposite gear position;

monitoring at least one operating parameter of the propulsion system until it passes a selected value; and thereafter commanding the transmission into neutral before the transmission engages into the opposite gear position;

monitoring at least one other operating parameter of the propulsion system until it passes a pre-determined value; and thereafter commanding the transmission to shift to the opposite gear position.

13. The method set forth in claim 12, wherein, prior to commanding the transmission to shift, said method further comprising the step of decreasing engine speed to below a first speed value.

14. The method set forth in claim 13, wherein said step of decreasing engine speed further comprises commanding the engine speed to an idle speed.

15. The method set forth in claim 12, wherein said step of monitoring at least one operating parameter further includes monitoring transmission fluid pressure until it falls below a first pressure value.

16. The method set forth in claim 15, wherein said first pressure value is a predetermined maximum gear disengage limit.

17. The method set forth in claim 12, wherein said step of monitoring at least one other operating parameter further comprises the step of monitoring engine speed until it increases to a selected speed value.

18. The method set forth in claim 12, wherein, after the last transmission shift command, said method further comprises the steps of waiting until the transmission fluid pressure increases above a predetermined engagement limit and waiting until the engine speed increases to an exit speed, and thereafter relinquishing engine speed control.

19. A method of controlling a marine propulsion system having an engine, a transmission, and a transmission clutch, comprising the steps of:

receiving a request to shift the transmission from an initial gear position to an opposite gear position;

sending a speed command to reduce the engine speed;

disengaging the transmission clutch by sending a transmission shift command to shift the transmission to the opposite gear position;

sending a transmission shift command to shift the transmission to neutral after disengagement of the transmission clutch;

sending a speed command to increase the engine speed; and sending a transmission shift command to shift the transmission to the opposite gear position after the engine speed has increased above a pre-determined speed.

20. A method of controlling a marine propulsion system having an engine and a transmission, comprising the steps of:

receiving a request to shift the transmission from an initial gear position to an opposite gear position;

reducing the speed of the engine to below a first speed value while maintaining the initial gear position;

commanding the transmission to the opposite gear position after the engine speed falls below the first speed value;

monitoring the pressure of transmission fluid contained in the transmission;

commanding the transmission to neutral after the transmission fluid pressure falls below a first pressure value and before the transmission engages in the opposite gear position;

increasing the engine speed to above a selected speed value;

commanding the transmission to the opposite gear position after the engine speed has reached the selected set speed value;

increasing the engine speed above an exit speed;

relinquishing engine speed control to a marine vessel operator once both of the following two conditions have occurred:

the transmission fluid pressure increases to a second pressure value; and the engine speed increases to the exit speed.

* * * * *